United States Patent [19]

Lowery

[11] Patent Number: 4,989,743

[45] Date of Patent: Feb. 5, 1991

[54] DEVICE FOR STORING CARBONATED BEVERAGES

[76] Inventor: Vance E. Lowery, Rte. 1, Box 297 KB, Catawaba, N.C. 28609

[21] Appl. No.: 458,416

[22] Filed: Dec. 28, 1989

[51] Int. Cl.[5] ..... B56D 35/00

[52] U.S. Cl. ..... 220/85 H; 222/103

[58] Field of Search ..... 220/401, 400, 402, 403, 220/408, 410, 1 R, 85 H, 93, 94 R, 85 B, 85 D; 222/95, 103, 105, 210, 214, 469; 215/1 C

[56] References Cited

U.S. PATENT DOCUMENTS

| | | | |
|---|---|---|---|
| 2,534,708 | 12/1950 | Goodheart | 222/103 |
| 2,587,191 | 2/1952 | Merullo | 222/103 |
| 3,565,292 | 2/1971 | Jinotti | 222/103 |
| 4,531,655 | 7/1985 | Putnam | 222/105 |
| 4,627,546 | 12/1986 | Carranza | 220/85 H X |
| 4,720,023 | 1/1988 | Jeff | 220/85 H X |

*Primary Examiner*—Steven M. Pollard

*Attorney, Agent, or Firm*—H. Jay Spiegel

[57] ABSTRACT

The present invention provides an improved device for storing carbonated beverages. The inventive device includes a container adapted to receive a carbonated beverage bottle. In combination with the container is a means to laterally compress the carbonated beverage bottle so as to reduce the gas volume within the bottle and reduce the loss of carbonation in the beverage. The improved device for storing carbonated beverages may also include a handle to facilitate pouring of the carbonated beverage while in the device.

5 Claims, 2 Drawing Sheets

DEVICE FOR STORING CARBONATED BEVERAGES

BACKGROUND OF THE INVENTION

The present invention relates to an improved device for storing carbonated beverages. In the prior art, devices for storing carbonated beverages are known. However, Applicant is unaware of any prior art that teaches or fairly suggests all of the features of the present invention including means to laterally compress a carbonated beverage container to maintain the carbonation of the beverage therein. The following prior art is known to Applicant:

U.S. Pat. No. 4,456,134 to Cooper discloses a carbonated beverage container having a collapsible portion and means to collapse the container and control the volume of the container. Of course, this patent is different from the teachings of the present invention in that Cooper does not teach or fairly suggest means being adapted to laterally compress a container having no collapsible portion therein.

U.S. Pat. No. 3,734,351 to Gaudin discloses a device for controlling the volume of a container and is seen to include a press means being adapted to compress a deformable bag. The teachings of this patent are different from the present invention in that Gaudin fails to teach or suggest the combination of a container and a means to compress a rigid carbonated beverage bottle.

SUMMARY OF THE INVENTION

The present invention relates to an improved device for storing carbonated beverages. The present invention includes the following interrelated aspects and features:

(a) In a first aspect, the present invention includes a cylindrical container having a first opening therein to receive a carbonated beverage bottle. The cylindrical container also includes a second opening therein, the second opening being adapted to receive a means for controlling the volume of the carbonated beverage bottle placed within the container.

(b) The means for controlling the volume of the carbonated beverage container may include a pressure plate located between the container sidewall and the carbonated beverage bottle. The pressure plate may have a curved shape that matches the contour of the container. In combination with the pressure plate is a threaded rod that is attached at one end to the pressure plate and includes a turning means attached at the other end thereof.

(c) The pressure plate includes a slotted opening therein for receiving and holding a flared end of the threaded rod. The second opening in the container has a threaded insert therein which is adapted to threadably receive the threaded rod such that when the threaded rod is rotated in a particular direction, the pressure plate compresses the carbonated beverage bottle, thereby decreasing the volume therein and extending the carbonated shelf life of the carbonated beverage in the bottle.

(d) The container also may include a handle thereon to facilitate pouring of the carbonated beverage in the bottle.

Accordingly, it is a first object of the present invention to provide an improved device for storing carbonated beverages.

It is a further object of the present invention to provide a device for storing carbonated beverages that includes means to adjust the volume of the carbonated beverage in the bottle and prevent the beverage from losing its carbonation.

It is a yet further object of the present invention to provide a device that also acts as a container to facilitate the pouring of the carbonated beverage.

These and other objects, aspects and features of the present invention will be better understood from the following detailed description of the preferred embodiment when read in conjunction with the appended drawing figures.

SPECIFIC DESCRIPTION OF THE PREFERRED EMBODIMENTS

Figure 1:
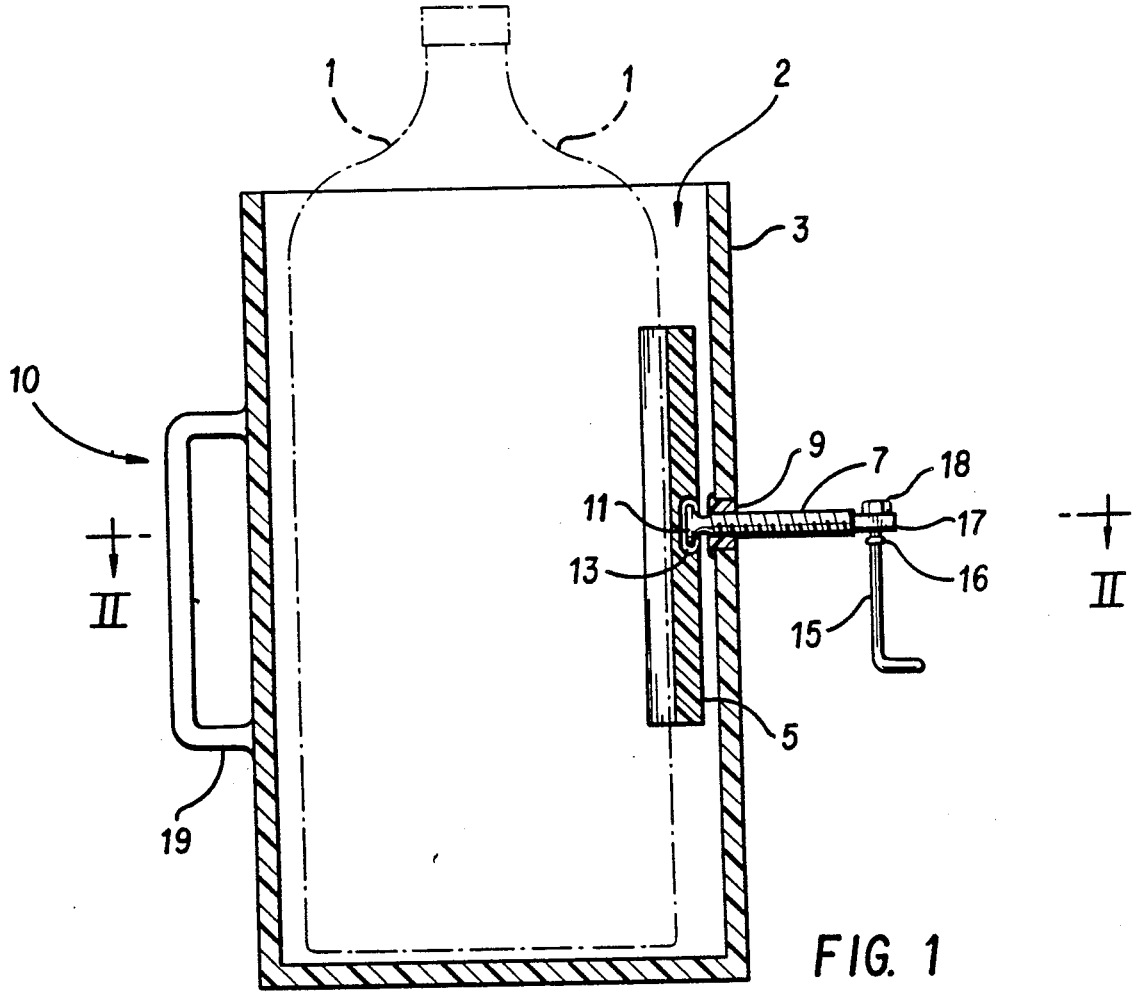
FIG. 1 shows an elevational view of the device of the present invention.

With reference to FIG. 1 firstly, the improved device for storing carbonated beverages is generally designated by the reference numeral 10 and is seen to include a carbonated beverage bottle 1 located within a container 3. Also illustrated in FIG. 1 is a pressure plate 5 located in the gap 2 between the bottle 1 and the container 3. The pressure plate 5 has an opening 13 therein for receiving the flared end 11 of a threaded rod 7. The flared end 11 may be integrally attached to the threaded rod 7 or may be connected by a rivet or other fastening means. The threaded rod 7 engages a complementary threaded insert 9 which is centrally located in the sidewall of container 3. The threaded rod 7 has at the other end a turning handle 15 which is attached to the threaded rod 7 by a leg 17 that is attached to the threaded rod 7. The handle 15 is inserted into an opening (not shown) in leg 17 and is secured to leg 17 by the stop means 16 and a threaded nut 18, threadably connected to the end of turning handle 15. Finally, a handle 19 is shown attached to the container 3 to facilitate pouring the carbonated beverage while it is held in the container 3. Although the handle is shown opposite the means for compressing the bottle, other locations may be utilized such as a location 90 degrees from the compressing means or adjacent to the compressing means.

Figure 2:
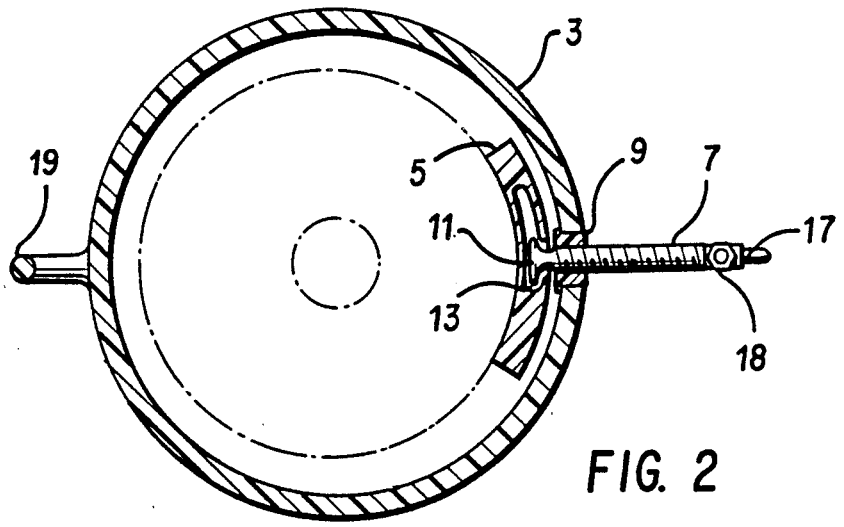
FIG. 2 shows a cross-sectional view along the line II-II of FIG. 1.

FIG. 2 shows a cross-sectional view along the line II-II of FIG. 1 and further illustrates the contoured shaped of the pressure plate 5.

Figure 3:
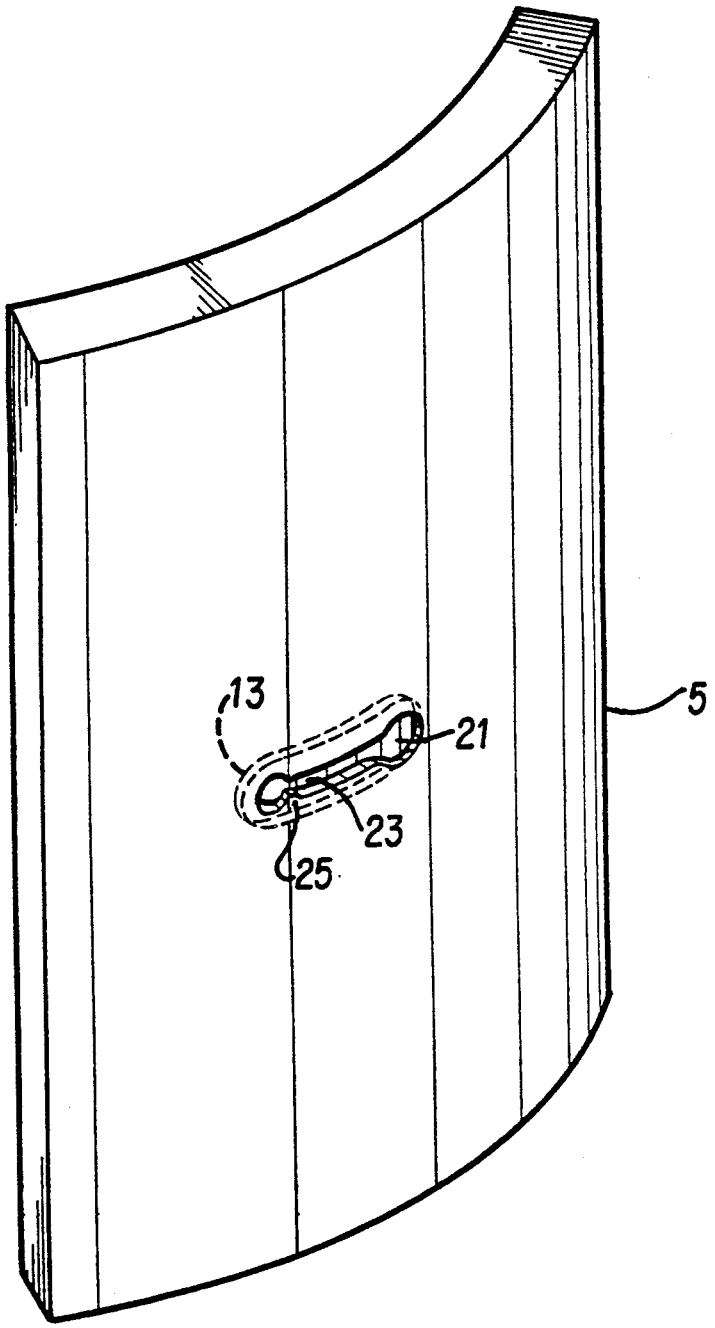
FIG. 3 shows a perspective view of the pressure plate of the device.

FIG. 3 depicts more clearly the slotted opening in the pressure plate 5. The slotted opening includes opening 13 which retains the flared end 11 of the threaded rod 7. Adjacent opening 13 are a pair of stops 25, a slot 23 and a second opening 21. In operation, the flared end 11 of the threaded rod 7 is inserted into opening 21 and slid along the slot 23 and past the stops 25. The stops 25 retain the flared end 11 in opening 13 during operation.

In operating the improved device for storing carbonated beverages, and with reference again to FIG. 1, the handle 15 is turned in a clockwise or counterclockwise direction to move the pressure plate 5 either against or away from the carbonated beverage bottle within the container 3. By compressing the carbonated beverage bottle with the cap off, the volume within the bottle is decreased and the level of the carbonated beverage rises to the top of the bottle. This removal of air from the carbonated beverage bottle decreases the loss of carbonation in the beverage. As is well known in the art, when a container holds a greater volumetric portion of a liquid as compared to a gas, the loss of gas from the liquid will be relatively low. The device of the present invention achieves this effect by decreasing the volume of gas as compared to the volume of liquid in the carbonated beverage bottle and reduces carbonation loss with respect to the liquid.

The gap 2 between the bottle 1 and the container 3 should be of sufficient width to accommodate any changes in the diameter of the bottle during compression. In particular, a rigid plastic bottle when compressed laterally may expand in other sections such that at a given height, the effective diameter of the bottle may be greater than the original diameter. Alternatively, the container should be of sufficient strength to withstand such expansion.

Of course, other means known in the art may be utilized to laterally compress the carbonated beverage bottle. For example, a trigger mechanism may be employed wherein pulling the trigger would activate a compressing means such as a bar or roller to laterally squeeze the carbonated beverage bottle.

The device of the present invention is adapted for all types of carbonated beverage bottles that may be compressed or squeezed. The rigid plastic bottles commonly used for carbonated beverages are especially adapted for the inventive device since they may be easily compressed in a lateral direction.

The improved device for storing carbonated beverages may be manufactured in a variety of dimensions. In particular, the container 3 may come in different sizes to accommodate different sized carbonated beverage bottles, e.g., two liter, one liter or three liter.

The components of the inventive device may be made of any material, a preferred material for the container would include either plastic or metal with the threaded rod and insert being preferably made of a metal material to enhance durability. A preferred material for the pressure plate may be either a plastic or metal material. Additionally, the pressure plate may come in a variety of thicknesses and contours. For example, a single container may utilize interchangeable pressure plates so as to accommodate various diameter carbonated beverage bottles.

As such, an invention has been disclosed in terms of a preferred embodiment thereof which fulfills each and every one of the objects of the present invention as set forth hereinabove and provides a new and improved device for storing carbonated beverages of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A device for storing carbonated beverages comprising:

(a) a cylindrical receptacle being adapted to receive a carbonated beverage container having a flexible sidewall; and (b) a means to compress said flexible sidewall of said carbonated beverage container laterally and decrease the volume of gas and raise the level of said beverage in said carbonated beverage container such that a beverage in said carbonated beverage container retains its carbonation over an extended period of time, said means being removably attachable to said cylindrical receptacle.

2. The invention of claim 1 further comprising a handle attached to said receptacle, said handle being adapted to assist in pouring said beverage.

3. The invention of claim 1, wherein said means to compress said flexible sidewall of said carbonated beverage container laterally further comprises:

(i) a pressure plate for compressing said flexible sidewall of said carbonated beverage container, said pressure plate being situated within and adjacent said receptacle;

(ii) a threaded insert located on said cylindrical receptacle and being adapted to receive a threaded rod; and (iii) a threaded rod being attachable at a first end thereof to said pressure plate and having means to turn said threaded rod being attachable at a second end thereof;

(iv) whereby rotation of said threaded rod in said threaded insert causes said pressure plate to compress said flexible sidewall of said carbonated beverage container.

4. The invention of claim 3, wherein said pressure plate includes a slotted opening therein to receive said first end of said threaded rod.

5. The invention of claim 1, wherein said means to compress said flexible sidewall of carbonated beverage containers includes a pressing means being capable of having different thicknesses so as to accommodate different size carbonated beverage containers in a said cylindrical receptacle.

* * * * *